United States Patent [19]

Lipani

[11] 4,188,907

[45] Feb. 19, 1980

[54] PARTICLE DISPENSER WITH A MAGNETICALLY DRIVEN AGITATOR

[75] Inventor: Anthony F. Lipani, Webster, N.Y.

[73] Assignee: Xerox Corporation, Stamford, Conn.

[21] Appl. No.: 823,567

[22] Filed: Aug. 11, 1977

[51] Int. Cl.[2] ..... G03G 15/09

[52] U.S. Cl. ..... 118/657; 222/233; 222/DIG. 1; 366/118; 366/196; 366/273

[58] Field of Search ..... 118/657, 658, 653; 222/233, DIG. 1, 196, 226; 366/118, 196, 273, 274

[56] References Cited

U.S. PATENT DOCUMENTS

| | | | |
|---|---|---|---|
| 2,166,671 | 7/1939 | Trofimov | 366/273 X |
| 2,892,446 | 6/1959 | Olden | 118/657 X |
| 3,179,302 | 4/1965 | Murray | 222/233 |
| 3,200,997 | 8/1965 | Creswick | 222/196 X |
| 3,462,285 | 8/1969 | Thompson | 118/653 |
| 3,534,914 | 10/1970 | Chaplenko | 366/118 X |
| 3,572,555 | 3/1971 | Knight | 222/DIG. 1 |
| 3,661,302 | 5/1972 | Braun | 222/226 X |
| 3,806,003 | 4/1974 | Fujimoto | 222/DIG. 1 |
| 3,987,967 | 10/1976 | Kuznetsov et al. | 366/273 X |
| 4,054,270 | 10/1977 | Gugger et al. | 366/273 X |
| 4,090,263 | 5/1978 | Hoffa | 366/273 |

FOREIGN PATENT DOCUMENTS

| | | | |
|---|---|---|---|
| 2166667 | 1/1975 | Fed. Rep. of Germany | 118/658 |

*Primary Examiner*—Mervin Stein
*Assistant Examiner*—Andrew M. Falik
*Attorney, Agent, or Firm*—J. J. Ralabate; C. A. Green; H. Fleischer

[57] ABSTRACT

An apparatus in which particles are dispensed from an open-ended chamber. An oscillatory magnetic field vibrates a magnetic member at least partially immersed in the particles. This prevents bridging and caking of the particles to facilitate flow of the particles from the open end of the chamber.

14 Claims, 7 Drawing Figures

PARTICLE DISPENSER WITH A MAGNETICALLY DRIVEN AGITATOR

BACKGROUND OF THE INVENTION

This invention relates generally to an electrophotographic printing machine, and more particularly concerns an improved development system for use therein.

In electrophotographic printing, the photoconductive member is charged to sensitize the surface thereof. The charged photoconductive member is exposed to a light image of the original document being reproduced. Exposure of the sensitized photoconductive surface discharges the charge selectively. This records an electrostatic latent image on the photoconductive surface corresponding to the informational areas contained within the original document being reproduced. Development of the electrostatic latent image recorded on the photoconductive surface is achieved by bringing developer material into contact therewith. The developer material generally comprises dyed or colored heat-settable plastic powders, known in the art as toner particles, which are mixed with coarser carrier granules, such as ferromagnetic granules. The toner particles and carrier granules are selected such that the toner particles acquire the appropriate charge relative to the electrostatic latent image recorded on the photoconductive surface. Thus, when developer material is brought into contact with the latent image recorded on the photoconductive surface, the greater attractive force thereof causes the toner particles to transfer from the carrier granules and adhere to the electrostatic latent image. This concept was originally disclosed by Carlson in U.S. Pat. No. 2,297,691 and is further amplified and described by many related patents in the art.

Various methods have been developed for applying developer material to the latent image. For example, the developer material may be cascaded over the latent image with the toner particle being attracted from the carrier granules thereto. Other apparatus employed to develop latent image include magnetic field producing devices which form brush-like tufts extending outwardly therefrom contacting the photoconductive surface.

With the advent of single component developer materials, i.e. conductive magnetic particles, carrier granules are no longer required.

It is apparent that during the development cycle, toner particles are depleted from the developer mix, or the single component developer material, itself, is depleted. Thus, additional particles must be furnished to maintain copy density at a substantially optimum level. In order to produce an efficient printing machine, it is necessary to conveniently and effectively replace the particles used in the formation of copies.

Hereinbefore, toner particles have been dispensed from a trough or hopper into the developer mix. However, more frequently the toner particles within the hopper bridge or cake so as to prevent the free flow thereof from the hopper to the developer material contained within the sump of the development system. This frequently results in light copies and customer dissatisfaction. In the past, this condition has been corrected by periodically manually stirring the toner particles contained within the replenishment container.

Accordingly, it is the primary object of the present invention to improve particle dispensing by preventing bridging and caking of the particles.

PRIOR ART STATEMENT

Various types of devices have hereinbefore been developed to improve the development system of an electrophotographic printing machine. The following prior art appears to be relevant:

| | | |
|---|---|---|
| 2,846,333 | Wilson | August 5, 1956 |
| 2,975,758 | Bird, Jr. | March 21, 1961 |
| 3,233,586 | Cranskins et al. | Feb. 8, 1966 |
| 4,014,291 | Davis | March 29, 1977 |

The pertinent portions of the foregoing prior art may be briefly summarized as follows:

Wilson discloses a magnetic roller applying magnetic particles to a latent image. The magnetic particles are disposed in the trough having the roller mounted rotatably therein.

Bird, Jr. teaches vibration of the trough to insure uniform mixing of the toner and carrier in the developer mix.

Davis describes a non-conductive tube interfit telescopically over a magnetic roller. The tube is positioned adjacent to a doctor blade located in the opening in a hopper storing toner particles. The toner particles fall from the blade onto the tube.

Cranskins et al. discloses a stripper in the shape of a comb or rake positioned closely adjacent to a magnetic roller for further loosening the developer powder.

It is believed that the scope of the present invention, as defined by the appended claims, is clearly patentably distinguishable over the foregoing prior art taken either singly or in combination with one another.

SUMMARY OF THE INVENTION

Briefly stated, and in accordance with the present invention, there is provided an apparatus for dispensing particles.

Pursuant to the features of the invention, the apparatus includes means, defining an open-ended chamber, for storing a supply of particles therein. A magnetic member, mounted movably in the chamber of the storing means engages the particles. Means are provided for generating an oscillatory magnetic field adjacent to the magnetic member. The magnetic field vibrates the magnetic member to prevent purging and caking of the particles. This facilitates flow of the particles from the open end of the storing means chamber.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
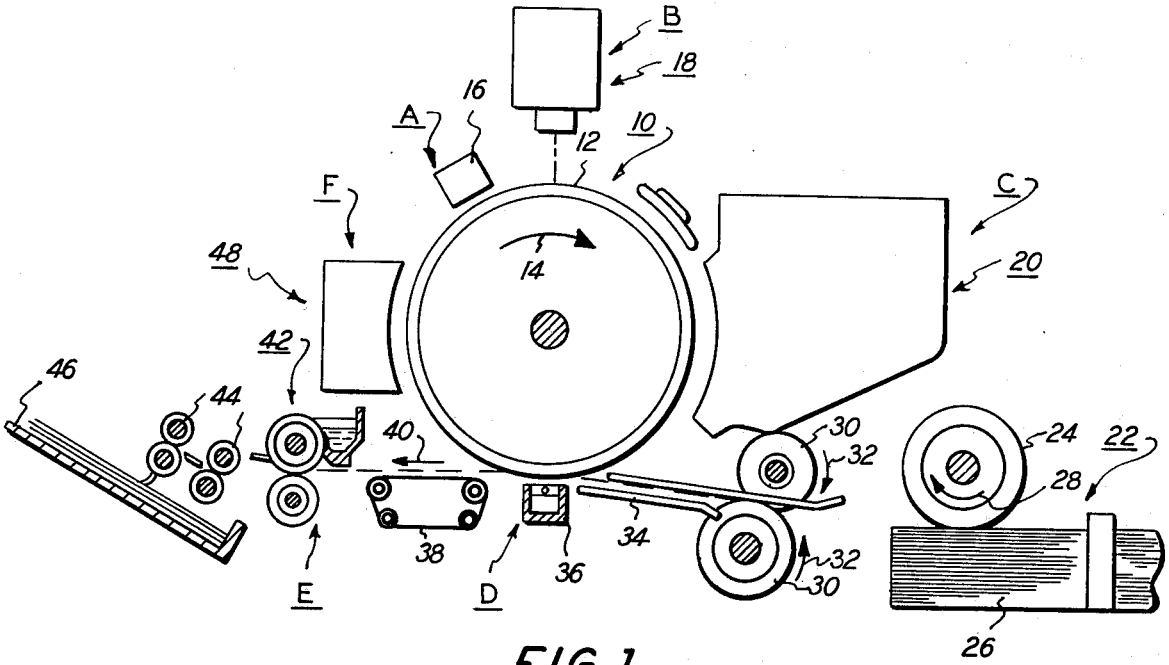
FIG. 1 illustrates a schematic elevational view of an electrophotographic printing machine incorporating the features of the present invention therein.

For a general understanding of an electrophotographic printing machine in which the features of the present invention may be incorporated, reference is had to FIG. 1 which depicts schematically the various components thereof. Hereinafter, like reference numerals will be employed throughout to designate identical elements. Although the development apparatus is particularly well adapted for use in electrophotographic printing, it should become evident from the following discussion that it is equally well suited for use in a wide variety of devices and is not necessarily limited in its application to the particular embodiment shown herein.

Inasmuch as the practice of electrophotographic printing is well known in the art, the various processing stations for producing a copy of an original document are represented in FIG. 1 schematically. Each processing station will be discussed briefly hereinafter.

As in all electrophotographic systems of the type illustrated, a drum 10 having photoconductive surface 12 entrained about and secured to the exterior circumferential surface of a conductive substrate is rotated, in the direction of arrow 14, through the various processing stations. One type of suitable photoconductive material is described in U.S. Pat. No. 2,970,906 issued to Bixby in 1961. Preferably, the conductive substrate is made from aluminum.

Initially, drum 10 rotates a portion of photoconductive surface 12 through charging station A. Preferably, charging station A utilizes a corona generating device, indicated generally by the reference numeral 16, to sensitize photoconductive surface 12. Corona generating device 16 is positioned closely adjacent to photoconductive surface 12. When energized, corona generating device 16 charges at least a portion of photoconductive surface 12 to a relatively high substantially uniform potential. For example, corona generating device 16 may be of the type described in U.S. Pat. No. 2,836,725 issued to Vyverberg in 1958.

Thereafter, drum 10 rotates the charged portion of photoconductive surface 12 to exposure station B. Exposure station B includes an exposure mechanism, indicated generally by the reference numeral 18, having a stationary, transparent platen, such as a glass plate or the like, for supporting an original document thereon. Scan lamps illuminate the original document. Scanning of the original document may be achieved by oscillating a mirror in a timed relationship with the movement of drum 10. This mirror is positioned beneath the platen to reflect the light image of the original document through a lens onto a mirror, which, in turn, transmits the light image through an apertured slit onto the charged portion of photoconductive surface 12. Irradiating the charged portion of photoconductive surface 12 selectively discharges the charge thereon to record an electrostatic latent image corresponding to the informational areas contained within the original document.

Drum 10 next rotates the electrostatic latent image recorded on photoconductive surface 12 to development station C. Development station C includes a developer unit, indicated generally by the reference numeral 20, having a housing with a supply of particles contained therein. Developer unit 20 is a magnetic brush type of development system. In a system of this type, the particles are brought through a directional flux field to form a brush thereof. The electrostatic latent image recorded on photoconductive surface 12 is developed by bringing the brush of particles into contact therewith. In this manner, the particles are attracted readily to the latent image forming a powder image on photoconductive surface 12. The detailed structure of developer unit 20 will be described hereinafter with reference to FIGS. 2 through 7, inclusive.

With continued reference to FIG. 1, a sheet of support material is advanced by sheet feeding apparatus 22 to transfer station D. Sheet feeding apparatus 22 includes a feed roll 24 contacting the uppermost sheet of the stack of sheets of support material 26. Feed roll 24 rotates in the direction of arrow 28 so as to advance the uppermost sheet from stack 26. Registration rollers 30, rotating in the direction of arrow 32, align and forward the advancing sheet of support material into chute 34. Chute 34 directs the advancing sheet of support material into contact with drum 10 in a timed sequence so that the powder image developed thereon contacts the advancing sheet of support material at transfer station D.

At transfer station D, corona generating device 36 applies a spray of ions to the backside of the sheet of support material. This attracts the powder image from photoconductive surface 12 to the sheet of support material. After transfer, the sheet is separated from photoconductive surface 12 and advanced by conveyor 38, in the direction of arrow 40, to fusing station E.

Fusing station E includes a fuser assembly, indicated generally by the reference numeral 42. Fuser assembly 42 permanently affixes the transferred toner powder image to the sheet of support material. After the toner powder image is permanently affixed to the sheet of support material, the sheet of support material is advanced by a series of rollers 44 to catch tray 46 for subsequent removal therefrom by the machine operator.

Invariably, after the sheet of support material is stripped from photoconductive surface 12 of drum 10, some residual particles remain adhering to photoconductive surface 12. These residual particles are removed from photoconductive surface 12 at cleaning station F. Cleaning station F includes a cleaning system, indicated generally by the reference numeral 48. The particles are cleaned from photoconductive surface 12 by a rotatably mounted fibrous brush in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts developer unit 20 in greater detail.

Figure 2:
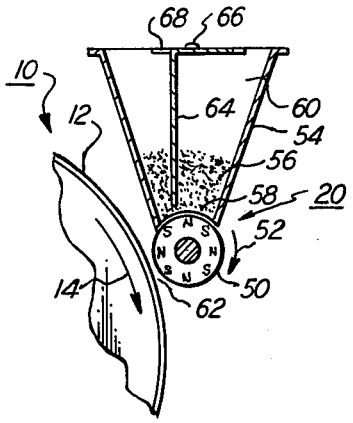
FIG. 2 shows a schematic elevational view of a development system employed in the FIG. 1 printing machine.

Turning now to FIG. 2, there is shown the detailed structure of developer unit 20. As depicted therein, developer unit 20 comprises a magnetic roller 50 having a plurality of magnetic poles impressed about the circumferential surface thereof. Magnetic rotor 50 is cylindrical. Preferably, magnetic rotor 50 is made from barrium ferrite having a plurality of magnetic poles impressed about the circumferential surface thereof. Adjacent poles are of opposed polarity. Magnetic rotor 50 rotates in the direction of arrow 52 so as to advance the developer material, i.e. magnetic particles such as ferrites, into contact with the electrostatic latent image recorded on photoconductive surface 12 of drum 10. In this manner, the magnetic particles are attracted from rotor 50 to the electrostatic latent image. This forms a powder image on photoconductive surface 12. Magnetic rotor 50 is positioned closely to photoconductive surface 12. In this manner, a brush of magnetic particles extend from rotor 50 into contact with photoconductive surface 12.

Hopper 54 stores a supply of particles 56 therein. The magnetic particles 56 are dispensed through opening 58 onto the circumferential surface of rotor 50. Thus, hopper 54 defines a chamber 60 for storing a supply of particles 56 therein. As rotor 50 rotates in the direction of arrow 52, the particles advance with the rotating magnetic field into development zone 62 or the gap between photoconductive surface 12 and rotor 50. In this manner, the particles are attracted electrostatically from rotor 52 the latent image recorded on photoconductive surface 12 rendering it visible.

Magnetic member or plate 64 has a portion thereof extending into particles 56 in chamber 60 of hopper 54. Magnetic plate 64 is mounted slidably on hopper 54 at the upper region thereof. Thus, ends 66 and 68 of magnetic plate 64 are secured slidably to hopper 54. As magnetic rotor 50 rotates in the direction of arrow 52, an oscillatory magnetic field is produced. The oscillatory magnetic field causes magnetic member 64 to vibrate. This vibration prevents the caking and bridging of particles 56 in chamber 60 of hopper 54. The detailed structure of magnetic member 64 will be discussed hereinafter with reference to FIGS. 3 through 7, inclusive.

Figure 3:
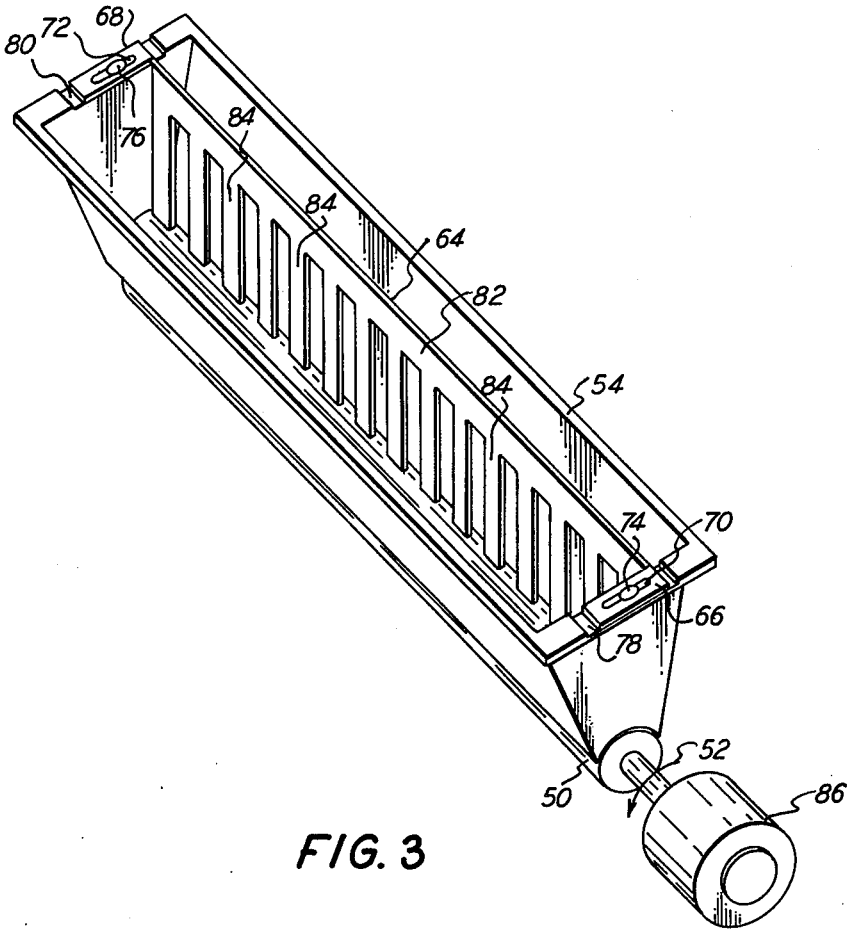
FIG. 3 depicts a schematic perspective view of the dispensing apparatus used in the FIG. 2 development system.

Referring now to FIG. 3, magnetic member 64 includes a pair of tabs 66 and 68 disposed at opposed ends of magnetic member 64. Tabs 66 and 68 have slots 70 and 72 therein. Pins or threaded fasteners 74 and 76 are located in hopper 54, in opposed ends thereof, and pass through slots 70 and 72, respectively. In this manner, tabs 66 and 68 are mounted slidably with respect to hopper 54. Tabs 66 and 68 are mounted in oversized recessed portions in hopper 54. Thus, recessed portion 78 receives tab 66 and recessed portion 80 receives tab 68. This permits tabs 66 and 68 to slide relative to hopper 54 within a prescribed boundary limit. Magnetic plate 64 includes an upper marginal portion 82 having a multiplicity of spaced strips 84 extending substantially parallel to one another in a downwardly direction into particles 56. Plate 64 is preferably made from a magnetic material, e.g. a magnetic sheet steel. Preferably, the sheet ranges from about 0.008 to about 0.010 inches thick. Thus, it is seen that magnetic plate 64 is configured in the shape of a comb or rake with teeth or strips 84 extending from the upper marginal portion 82 thereof and being immersed in the particles. As the teeth vibrate under the influence of the oscillator magnetic field generated by rotor 50, caking and bridging of the particles is prevented. This facilitates the free flow of the particles from opening 58 onto rotor 50.

With continued reference to FIG. 3, motor 86 rotates magnetic rotor 50 in the direction of arrow 52 so as to produce the rotating or oscillatory magnetic field which vibrates magnetic plate 64. Thus, the system not only induces vibration which prevents bridging and caking of the particles and facilitates the free flow thereof onto the magnetic rotor, but, substantially simultaneously therewith, deposits the particles onto the electrostatic latent image recorded on photoconductive surface 12. In this manner, magnetic rotor 50 acts in a dual capacity, i.e. it generates an oscillatory magnetic field and deposits particles onto a photoconductive surface 12 so as to develop the electrostatic latent image recorded thereon.

Figure 4:
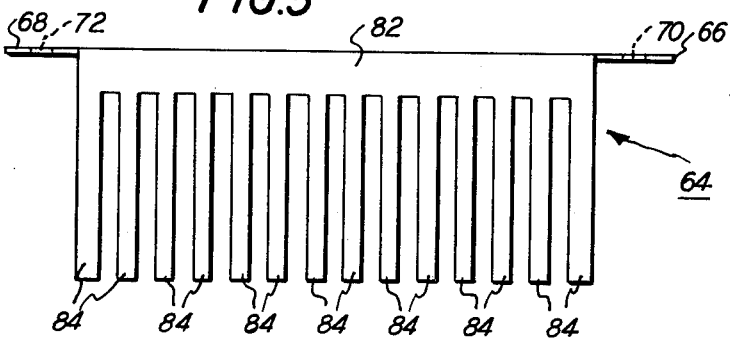
FIG. 4 illustrates a front elevational view of the magnetic member employed in the FIG. 3 dispensing apparatus.

Turning now to FIG. 4, there is shown a front elevational view of plate 64. Plate 64 is made from sheet steel and includes a plurality of substantially equally spaced strips 84 extending from a common marginal portion 82. Tabs 66 and 68 extend outwardly from either end of upper marginal region 82 so as to interfit slidably in recessed portions 78 and 80 of hopper 54 (FIG. 3). In operation, the teeth or strips 84 are immersed in the particles in hopper 54. Thus, the teeth vibrate through the particles producing a comb or raking action as rotor 50 rotates in the direction of arrow 52. This combing or raking action prevents the particles from caking or bridging. In this manner, the flow of the particles from hopper 54 onto rotor 50 is facilitated.

Figure 5:
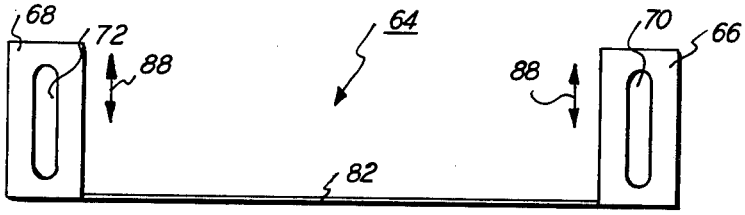
FIG. 5 shows a plan elevational view of the magnetic member.

Referring now to FIG. 5, there is shown an elevational plan view of magnetic plate 64. As illustrated therein, tabs 66 and 68 extend substantially normal to upper marginal region 82 of plate 64. Slots 70 and 72 are formed in tabs 66 and 68 extending substantially normal to marginal portion 82. In this way, the vibration of plate 64 is constrained in the direction of arrow 88, i.e. substantially parallel to tab 68 and 66 or slots 70 and 72.

Figure 6:
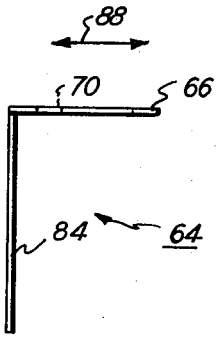
FIG. 6 depicts a side elevational view of the magnetic member.

Referring now to FIG. 6, there is shown one embodiment of strips or teeth 84. As depicted therein strips 84 are thin and plate 56 appears to be L-shaped when viewed from the side. Tabs 66 and 68 forming an L with strips 84. Once again, slot 70 is formed in tab 66 and extends in a direction substantially parallel to tab 66 permitting plate 64 to vibrate in the direction of arrow 88.

Figure 7:
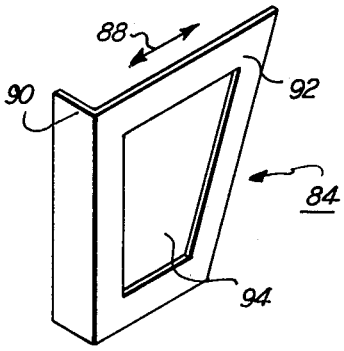
FIG. 7 illustrates a perspective view of another embodiment of a portion of the magnetic member.

Referring now to FIG. 7, there is shown an alternate embodimemt of strips 84. As depicts therein, strips 84 comprise a front portion 90 and a side portion 92 substantially trapezoidal in shape. Side portion 92 has a central region 94, also trapezoidal in shape, cut out therefrom. The plane defined by front portion 90 is substantially normal to the direction of movement of plate 64 as defined by arrow 88. Contrawise, the plane defined by side portion 92 is substantially parallel to the direction of movement of plate 64 as defined by arrow 88. Side portion 92 extends to the rear of hopper 54, and as plate 64 vibrates in the direction of arrow 88, it breaks loose the particles against the back ledge or wall of hopper 54.

Plates 64 may be mounted with respect to hopper 54 so as to enable it to sweep the full depth, front to back of the hopper, so as to dislodge all of the particles. The strips or fingers of the comb or rake can be lightly coated with a thin plastic to reduce the noise caused by the vibration of the plate as it engages the walls of hopper 54. Alternatively, when a two component developer material is employed, the plate can be coated with a suitable plastic material which will induce a triboelectric charge on the toner particles so as to eliminate the need for an inductive type of carrier. This also eliminates the need for the application of a high A.C. bias on the magnetic rotor.

Another embodiment of magnetic plate 64 will only have the lower region of strips 84, i.e. the bottom $\frac{1}{8}$ or $\frac{1}{4}$ inch constructed of a magnetic material. The remainder of plate 64 could be constructed from a non-magnetic material, i.e. plastic, aluminum, wood, etc. Also, it is feasible to fabricate other sections of the hopper 54 from a magnetic material such that the fluctuating magnetic field, i.e. the oscillating magnetic field produced by the rotation of rotor 50, will induce controlled vibration to release the particles from the walls of hopper 54 and to prevent bridging and caking thereof. This would require that various portions of hopper 54 be free to vibrate under the influence of the oscillating magnetic field.

In recapitulation, it is evident that the apparatus of the present invention introduces a controlled vibration so as to comb or rake particles stored within a hopper preventing the bridging and caking thereof. This vibration is produced by a magnetic rotor adapted to deposit the particles on an electrostatic latent image recorded on a photoconductive surface. Thus, the magnetic rotor acts in a dual compacity, i.e. to create or generate an oscillatory magnetic field for vibrating a magnetic plate and to deposit particles onto an electrostatic latent image. This insures that the particles flow freely from the storage hopper onto the peripheral surface of the magnetic rotor optimizing development and insuring high quality copies in the printing machine.

It is, therefore, evident that there has been provided, in accordance with the present invention, a development system that fully satisfies the objects, aims and advantages hereinbefore set forth. While this invention has been described in conjunction with a specific embodiment thereof, it is evident that many alternatives, modifications and variations will be apparent to those skilled in the art. Accordingly it is intended to embrace all such alternatives, modifications and variations as fall within the spirit and broad scope of the appended claims.

What is claimed is:

1. An apparatus for dispensing particles, including:

means, defining an open ended chamber, for storing a supply of particles therein;

a magnetic member mounted movably in the chamber of said storing means and having a portion thereof engaging the particles;

a roller having at least a pair of magnetic poles of opposed polarity impressed on the circumferential surface thereof; and means for rotating said roller to produce an oscillatory magnetic field for vibrating said magnetic member to prevent bridging and caking of the particles, thereby facilitating flow of the particles from the open end of the chamber of said storing means.

2. An apparatus as recited in claim 1, wherein said magnetic member includes a plate comprising a multiplicity of spaced strips extending substantially parallel to one another from a common marginal portion thereof.

3. An apparatus as recited in claim 2, wherein said magnetic member includes means for securing slidably said plate to said storing means.

4. An apparatus as recited in claim 3, wherein said roller is mounted in the open end of the chamber of said storing means.

5. An apparatus for developing a latent image recorded on a member, including:

means, defining an open ended chamber, for storing a supply of particles therein;

a magnetic member mounted movably in the chamber of said storing means and having a portion thereof engaging the particles; and unitary means, in communication with said storing means, for depositing particles on the latent image and for simultaneously generating an oscillatory magnetic field adjacent said magnetic member for vibrating said magnetic member to prevent bridging and caking of the particles flowing from the open end of the chamber of said storing means.

6. An apparatus for developing a latent image recorded on a member, including:

means, defining an open ended chamber, for storing a supply of particles therein;

a magnetic member mounted movably in the chamber of said storing means and having a portion thereof engaging the particles;

a roller having at least a pair of magnetic poles of opposed polarity impressed on the circumferential surface thereof, said roller being positioned closely adjacent to the latent image for depositing particles thereon; and means for rotating said roller to produce an oscillatory magnetic field for vibrating said magnetic member to prevent bridging and caking of the particles flowing from the open end of the chamber of said storing means.

7. An apparatus as recited in claim 6, wherein said magnetic member includes a plate comprising a multiplicity of spaced strips extending substantially parallel to one another from a common marginal portion thereof.

8. An apparatus as recited in claim 7, wherein said magnetic member includes means for securing slidably said plate to said storing means.

9. An apparatus as recited in claim 8, wherein said roller is mounted in the open end of the chamber of said storing means.

10. An electrophotographic printing machine of the type having an electrostatic latent image recorded on a photoconductive member, wherein the improvement includes:

means, defining an open ended chamber, for storing a supply of particles therein;

a magnetic member mounted movably in the chamber of said storing means and having a portion thereof engaging the particles; and unitary means, in communication with said storing means, for depositing particles on the latent image and for simultaneously generating an oscillatory magnetic field adjacent said magnetic member for vibrating said magnetic member to prevent bridging and caking of the particles flowing from the open end of the chamber of said storing means.

11. An electrophotographic printing machine of the type having an electrostatic latent image recorded on a photoconductive member, wherein the improvement includes:

means, defining an open ended chamber, for storing a supply of particles therein;

a magnetic member mounted movably in the chamber of said storing means and having a portion thereof engaging the particles;

a roller having at least a pair of magnetic poles of opposed polarity impressed on the circumferential surface thereof, said roller being positioned closely adjacent to the photoconductive member for depositing particles on the latent image; and means for rotating said roller to produce an oscillatory magnetic field for vibrating said magnetic member to prevent bridging and caking of the particles flowing from the open end of the chamber of said storing means.

12. A printing machine as recited in claim 11, wherein said magnetic member includes a plate comprising a multiplicity of spaced strips extending substantially parallel to one another from a common marginal region thereof.

13. A printing machine as recited in claim 12, wherein said magnetic member includes means for securing slidably said plate to said storing means.

14. A printing machine as recited in claim 13, wherein said roller is mounted in the open end of the chamber of said storing means.

* * * * *